US010271384B2

(12) United States Patent
Ooyama et al.

(10) Patent No.: US 10,271,384 B2
(45) Date of Patent: Apr. 23, 2019

(54) DIRECT RESISTANCE HEATING METHOD

(71) Applicant: NETUREN CO., LTD., Shinagawa-ku, Tokyo (JP)

(72) Inventors: Hironori Ooyama, Tokyo (JP); Kunihiro Kobayashi, Tokyo (JP)

(73) Assignee: NETUREN CO., LTD., Tokyo (JP)

( * ) Notice: Subject to any disclaimer, the term of this patent is extended or adjusted under 35 U.S.C. 154(b) by 28 days.

(21) Appl. No.: 14/410,727

(22) PCT Filed: Jul. 5, 2013

(86) PCT No.: PCT/JP2013/069076

§ 371 (c)(1),
(2) Date: Dec. 23, 2014

(87) PCT Pub. No.: WO2014/010712

PCT Pub. Date: Jan. 16, 2014

(65) Prior Publication Data

US 2015/0173125 A1 Jun. 18, 2015

(30) Foreign Application Priority Data

Jul. 7, 2012 (JP) ..... 2012-153149

(51) Int. Cl.

| | |
|---|---|
| ***H05B 3/02*** | (2006.01) |
| ***C21D 9/00*** | (2006.01) |
| ***C21D 1/40*** | (2006.01) |
| ***H05B 3/00*** | (2006.01) |
| ***H05B 3/03*** | (2006.01) |

(52) U.S. Cl.

CPC ..... *H05B 3/023* (2013.01); *C21D 1/40* (2013.01); *C21D 9/0068* (2013.01); *H05B 3/0095* (2013.01); *H05B 3/03* (2013.01)

(58) Field of Classification Search

CPC ..... C21D 1/40; C21D 9/0068; C21D 9/46; C21D 1/673; C21D 9/0012;
(Continued)

(56) References Cited

U.S. PATENT DOCUMENTS 3,564,189 A * 2/1971 Rhodes ..... B23K 11/061 219/61.12
5,676,862 A * 10/1997 Matteson ..... B23K 11/063 219/110
(Continued)

FOREIGN PATENT DOCUMENTS

| | | |
|---|---|---|
| EP | 2236226 | 10/2010 |
| JP | 53-007517 | 1/1978 |

(Continued)

OTHER PUBLICATIONS

International Search Report for PCT/JP2013/069076, dated Sep. 30, 2013.

*Primary Examiner* — Tu B Hoang
*Assistant Examiner* — Masahiko Muranami
(74) *Attorney, Agent, or Firm* — Wenderoth, Lind & Ponack, L.L.P.

(57) ABSTRACT

A direct resistance heating method includes placing a first electrode and a second electrode on a plate-shaped workpiece such that the first electrode and the second electrode extend across the workpiece in a direction substantially perpendicular to a center line of a heating target region of the workpiece, the center line connecting a middle portion of one side of the heating target region and a middle portion of the other side of the heating target region; and moving at least one of the first electrode and the second electrode along the center line while applying electric current between the first electrode and the second electrode.

6 Claims, 8 Drawing Sheets

(58) Field of Classification Search
CPC .. C21D 2221/00; C21D 2221/10; C21D 9/50; C21D /; H05B 3/023; H05B 3/03; H05B 3/0004; H05B 1/023; H05B 3/0023; H05B 3/0095; B21D 22/022; B23K 11/317; B23K 11/318; B23K 26/03; B23K 9/0953; B29B 17/02; B29B 2017/0262; B29K 2055/02; B29K 2705/00; B29K 2705/08; B29K 2705/10; B29L 2009/005; B29L 2031/3425; H01J 61/305; H01J 61/09
USPC ..... 219/600, 162, 645, 148, 546, 553, 538, 219/121.6, 130.01, 60 A, 86.25, 89, 48, 219/81, 84, 85.16, 119, 523, 86.41, 86.24, 219/88, 774, 542, 539, 216, 83, 159
See application file for complete search history.

(56) References Cited

U.S. PATENT DOCUMENTS

2003/0217991 A1* 11/2003 Gomez ..... C21D 1/40 219/50
2005/0224467 A1* 10/2005 Val ..... B23K 11/067 219/83
2009/0065494 A1* 3/2009 DeMichael ..... B23P 6/002 219/482
2010/0269559 A1* 10/2010 Ishiguro ..... C21D 1/673 72/342.1
2010/0285328 A1* 11/2010 Nonomura ..... B21D 22/02 428/600
2010/0326965 A1* 12/2010 Hasegawa ..... B23K 11/067 219/117.1
2012/0074103 A1* 3/2012 Hasegawa ..... B23K 11/061 219/102

FOREIGN PATENT DOCUMENTS

| | | |
|---|---|---|
| JP | 06-079389 | 3/1994 |
| JP | 2000-265219 | 9/2000 |
| JP | 2003-290810 | 10/2003 |
| JP | 3587501 | 8/2004 |
| JP | 4604364 | 10/2010 |
| JP | 2013-114942 | 6/2013 |

* cited by examiner

DIRECT RESISTANCE HEATING METHOD

CROSS-REFERENCE TO RELATED APPLICATIONS

The present application is a national stage application of International Application No. PCT/JP2013/069076 filed on Jul. 5, 2013, claiming priority from Japanese Patent Application No. 2012-153149 filed on Jul. 7, 2012, the entire contents of which are incorporated herein by reference.

TECHNICAL FIELD

The present invention relates to a direct resistance heating method in which an electric current is applied to a plate-shaped workpiece.

BACKGROUND ART

Heat treatment is applied to, for example, vehicle structures such as a center pillar and a reinforcement to ensure strength. Heat treatment can be classified into two types, namely, indirect heating and direct heating. An example of indirect heating is a furnace heating in which a workpiece is placed inside a furnace and the temperature of the furnace is controlled to heat the workpiece. Examples of direct heating include induction heating in which an eddy current is applied to a workpiece to heat the workpiece, and a direct resistance heating (also called as a direct electric conduction heating) in which an electric current is applied directly to a workpiece to heat the workpiece.

According to a first related art, a metal blank is heated by induction heating or direct resistance heating prior to being subjected to plastic working by working means. For example, the heating means having electrode rollers or an induction coil is disposed upstream of the working means having a cutter machine, and the metal blank is heated while continuously being conveyed (see, e.g., JP06-079389A).

According to a second related art, to heat a steel plate having a substantially constant width along the longitudinal direction of the steel plate by direct resistance heating, electrodes are arranged on respective end portions of the steel plate in the longitudinal direction, and a voltage is applied between the electrodes. In this case, because an electric current flows uniformly through the steel plate, an amount of heat generation is uniform over the entire steel plate. On the other hand, to heat a steel plate having a varying width along the longitudinal direction of the steel plate, a set of multiple electrodes are disposed side by side on one side of the steel plate in the widthwise direction, and another set of multiple electrodes are disposed side by side on the other side of the steel plate in the widthwise direction, such that the electrodes disposed on respective sides of the steel plate in the widthwise direction form multiple pairs of electrodes. In this case, an equal electric current is applied between each of the pair of electrodes, so that the steel plate is heated to a uniform temperature (see, e.g., JP4604364B2 and JP3587501B2).

According to a third related art, a first electrode is fixed to one end of a steel rod, and a clamping-type second electrode is provided to hold the boundary between a portion of the steel rod to be heated and a portion of the steel rod to be non-heated, so that the steel rod is partially heated (see, e.g., JP53-007517A).

According to a fourth related art, a direct resistance heating method is used for a non-rectangular workpiece. Specifically, direct resistance heating is performed for each rectangular portion of the workpiece. While cooling the heated portion of the workpiece, direct resistance heating is performed on the non-heated portion of the workpiece (see, e.g., Technical Disclosure No. 2011-504351 issued on Nov. 1, 2011, Journal of Technical Disclosure, Japan Institute of Invention and Innovation).

When heating a workpiece, in particular, a workpiece having a varying width along the longitudinal direction of the workpiece, it is preferable that an amount of heat applied per unit volume is the same over the entire workpiece, like in the furnace heating. However, a heating furnace requires large-scale equipment, and a temperature control of the furnace is difficult.

Accordingly, in terms of production cost, direct resistance heating is preferable. However, when a plurality of pairs of electrodes is provided like in the second related art, an amount of electric current to be applied is controlled for each of the pairs of electrodes, which increases installation cost. Further, arrangement of a plurality of pairs of electrodes with respect to one workpiece reduces productivity.

SUMMARY OF INVENTION

It is an object of the present invention to provide a direct resistance heating method capable of substantially uniformly heating a portion of a plate-shaped workpiece having a varying width along a longitudinal direction of the workpiece.

According to an aspect of the present invention, a direct resistance heating method includes placing a first electrode and a second electrode on a plate-shaped workpiece such that the first electrode and the second electrode extend across the workpiece in a direction substantially perpendicular to a center line of a heating target region of the workpiece, the center line connecting a middle portion of one side of the heating target region and a middle portion of the other side of the heating target region; and moving at least one of the first electrode and the second electrode along the center line while applying electric current between the first electrode and the second electrode.

One of the first electrode and the second electrode may be moved along the center line and in a direction in which the resistance per unit length of the workpiece increases, so as to adjust a time during which the electric current is applied for each portion of the heating target region.

According to the present invention, the first electrode and the second electrode are placed such that the first and second electrodes extend across the plate-shaped workpiece in the direction substantially perpendicular to the center line of a heating target region of the workpiece, the center line connecting the middle portion of one side of the heating target region and the middle portion of the other side of the heating target region. Therefore, an interval along the longitudinal direction of the workpiece between a portion of the workpiece contacting the first electrode and a portion of the workpiece contacting the second electrode falls within the same range, irrespective of the location on the workpiece in a widthwise direction of the workpiece. That is, the amount of electric current applied between the first electrode and the second electrode can be made to fall within the same range, irrespective of the location on the workpiece in the widthwise direction. Accordingly, it is possible to substantially uniformly heat a predetermined region of the workpiece.

When the resistance per unit length of the workpiece increases along the center line, the time during which the electric current is applied can be adjusted for each portion of the heating target region by moving one of the first electrode and the second electrode in a direction in which the resistance increases. In this way, it is possible to substantially uniformly heat the heating target region.

BRIEF DESCRIPTION OF DRAWINGS

FIGS. 1A to 1D are diagrams illustrating a direct resistance heating method according to an embodiment of the present invention, in which FIG. 1A is a plan view illustrating a state before direct resistance heating, FIG. 1B is a front view illustrating the state before the direct resistance heating, FIG. 1C is a plan view illustrating a state after the direct resistance heating, and FIG. 1D is a front view illustrating the state after the direct resistance heating;

FIGS. 3A and 3B are diagrams illustrating an arrangement of a workpiece with respect to the electrodes, in which FIG. 3A is a plan view illustrating a state before direct resistance heating and FIG. 3B is a plan view illustrating a state after the direct resistance heating;

FIGS. 5A and 5B are diagrams illustrating another arrangement of the workpiece with respect to the electrodes where the workpiece is arranged without being rotated in a horizontal plane, in which FIG. 5A is a plan view illustrating a state before direct resistance heating and FIG. 5B is a plan view illustrating a state after the direct resistance heating;

DESCRIPTION OF EMBODIMENTS

Figure 1A:
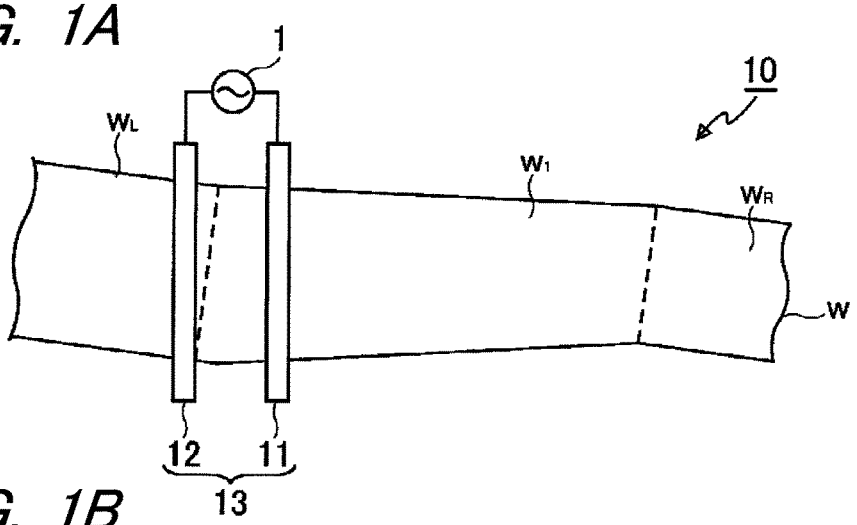
Figure 1B:
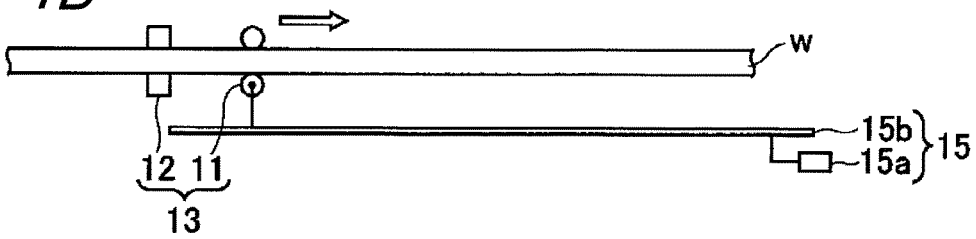

Hereinafter, embodiments of the present invention will be described in detail with reference to the drawings. In the following embodiments, a direct resistance heating is performed on a workpiece having a shape of a flat plate. Examples of the workpiece includes a workpiece whose thickness is constant and whose width does not vary along a longitudinal direction of the workpiece, a workpiece having a region to be heated (hereinafter "heating target region") whose width or thickness varies along a direction from one end to the other end of the heating target region so that a sectional area thereof is decreased or increased, and a workpiece in which an opening or a cut-out region is provided in the heating target region and, in a longitudinal direction of the workpiece, a dimension of the cross section perpendicular to the longitudinal direction is decreased or increased. Material of the workpiece may be a steel material which can be subjected to direct resistance heating by supplying current thereto, for example. The workpiece may be configured by a single piece or may be configured by an integral body which is obtained by joining the materials with different resistivity by a welding process, etc. Further, the workpiece may be provided with one heating target region or a plurality of heating target regions. When the workpiece is provided with a plurality of heating target regions, the heating target regions may be adjacent to each other or may be spaced apart from each other.

As shown in FIGS. 1A to 1D, a direct resistance heating apparatus 10 for a direct resistance heating method according to an embodiment of the present invention includes a first electrode 11 and a second electrode 12 forming a pair of electrodes 13. The first electrode 11 and the second electrode 12 have a roll shape or a quadrilateral shape extending in the same direction across the workpiece w. The first electrode 11 and the second electrode 12 are electrically connected to a power feeding unit 1 and a part of the workpiece w located between the first electrode 11 and the second electrode 12 is subjected to direct resistance heating.

In the direct resistance heating apparatus 10 shown in FIG. 1, the first electrode 11 is a roll-shaped moving electrode. The first electrode 11 is configured to be moved by a moving mechanism 15 along a longitudinal direction of the workpiece w while contacting the workpiece w.

That is, in a state where current is supplied to the workpiece w from the power feeding unit 1 through the pair of electrodes 13 while the first electrode 11 and the second electrode 12 are brought into contact with the workpiece w, the moving mechanism 15 can move the first electrode 11 to change an interval between the first electrode 11 and the second electrode 12.

The moving mechanism 15 includes an adjustment unit 15*a* configured to control a moving speed of the first electrode 11 and a drive mechanism 15*b* configured to move the first electrode 11 by the adjustment unit 15*a*. The adjustment unit 15*a* obtains the moving speed of the first electrode 11 from data on the shape and dimensions of the workpiece w, in particular, a heating target region $w_1$ and the drive mechanism 15*b* is intended to move the first electrode 11 by the obtained moving speed.

The second electrode 12 may a fixed electrode or may be a moving electrode to be moved by a separate similar moving mechanism. In the below description, it is assumed that the first electrode 11 can be moved by the moving mechanism 15. Of course, the first electrode 11 may be in a state of being fixed, depending on the shape of the workpiece w, etc.

As shown in FIG. 1A, the first electrode 11 and the second electrode 12 have a length spanning a front end and a rear end of the workpiece w as seen in a plan view, irrespective of the site of the workpiece w in the longitudinal direction.

Figure 1C:
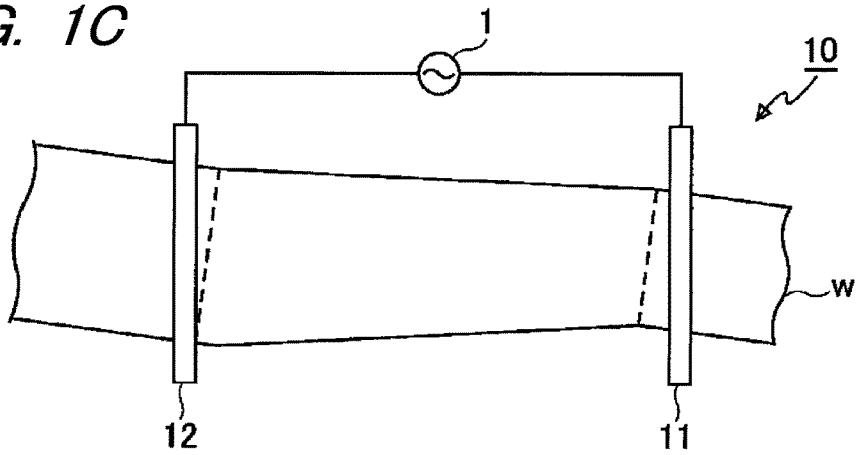

The workpiece w has, for example, a shape of a flat plate extending from one side to the other side substantially along the longitudinal direction of the workpiece w. As shown in FIGS. 1A and 1C, the workpiece w has an irregular shape whose width varies along the longitudinal direction of the workpiece w. In addition, the workpiece w exhibits a trapezoidal shape in which one end and the other end of the heating target region $w_1$ of the workpiece w are substantially parallel to each other. A left region $w_L$ is provided in a left side of the heating target region $w_1$. A right region $w_R$ is provided in a right side of the heating target region $w_1$. In the embodiment shown in FIG. 1, the workpiece w includes the left region $w_L$ on the left side of the heating target region $w_1$ and the right region $w_R$ on the right side of the heating target region $w_1$, which are respectively provided in a continuous form. However, according to another embodiment of the present invention, the workpiece w may include only one of the left region $w_L$ and the right region $w_R$ or may not include both of them.

Figure 3A:
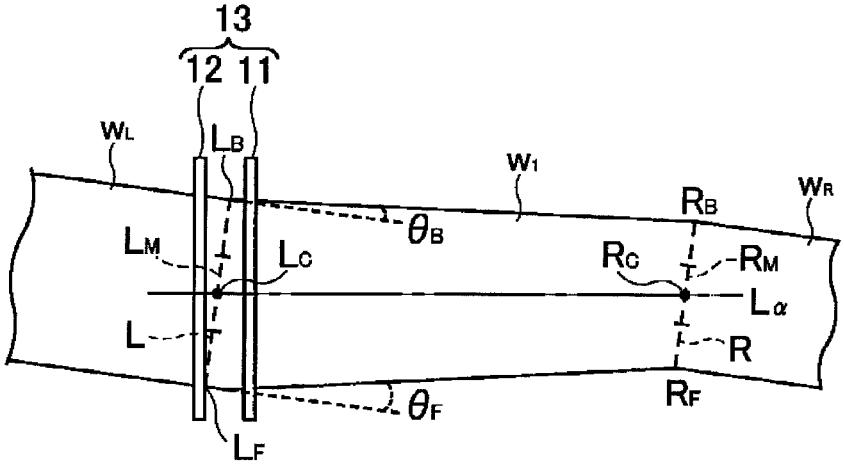
Figure 3B:
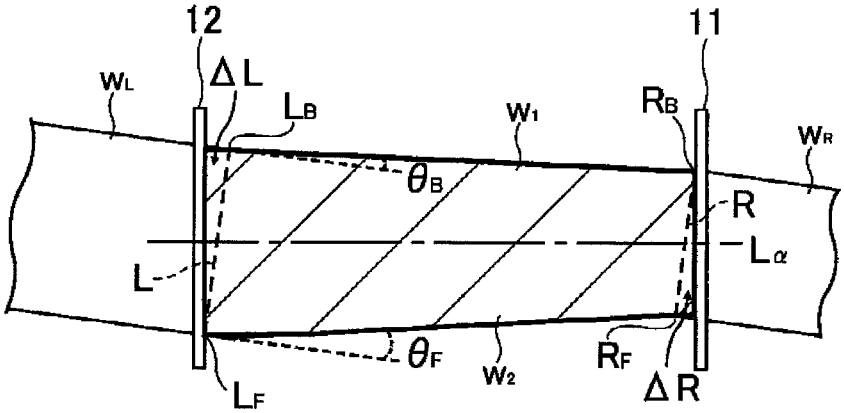

When arranging the first electrode 11 and the second electrode 12 extending in the same direction across the workpiece w on the plate-shaped workpiece w, each of the electrodes 11, 12 is placed on the workpiece w in a state in which the workpiece w is rotated in the horizontal plane or each of the electrodes 11, 12 is rotated in the horizontal plane so that a center line $L_\alpha$ connecting a middle portion $L_M$ of one side L of the heating target region $w_1$ and a middle portion $R_M$ of the other side R of the heating target region $w_1$ is substantially perpendicular to the electrodes 11, 12, as shown in FIGS. 3A and 3B. For example, in a case in which the pair of electrodes 13 is configured by the first electrode 11 and the second electrode 12 extending across the workpiece w, the workpiece w extending substantially in the longitudinal direction is turned in a horizontal plane and the pair of electrodes 13 is placed on the workpiece w.

Hereinafter, how to place the workpiece w to the pair of electrodes 13 will be described in detail.

Figure 2:
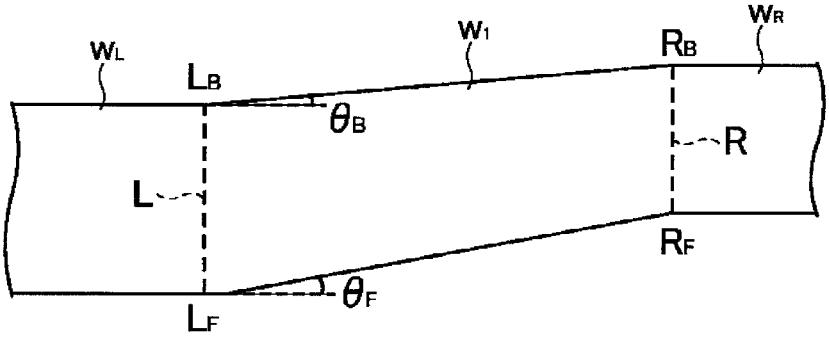
FIG. 2 is a plan view illustrating an example of a shape of a workpiece to be heated by the direct resistance heating method according to the embodiment.

FIG. 2 is a plan view showing an example of the shape of the workpiece w employed in the illustrative embodiment of the present invention. The workpiece w employed in the illustrative embodiment of the present invention includes the left region $w_L$ on the left side of the heating target region $w_1$ and the right region $w_R$ on the right side of the heating target region $w_1$, as shown in FIG. 2. The left side (one side) L of the heating target region $w_1$ includes a front point $L_F$ on a front end and a rear point $L_B$ on a rear end, as seen in a plan view. A right side (the other side) R of the heating target region $w_1$ includes a front point $R_F$ on a front end and a rear point $R_B$ on a rear end, as seen in a plan view.

Further, as shown in FIG. 2, when an angle between an extended line to the right of the front point $L_F$ of the left region $W_L$ and a straight line $R_FL_F$ is defined as $\theta_F$ and an angle between an extended line to the right of the rear point $L_B$ of the left region $W_L$ and a straight line $R_BL_B$ is defined as $\theta_B$, as seen in a plan view, all of the angles $\theta_F$, $\theta_B$ have a positive valve in a counter-clockwise direction, as seen in a plan view around the front point $L_F$ and the rear point $L_B$, respectively. Meanwhile, all of the angles $\theta_F$, $\theta_B$ may have a negative valve in a clockwise direction, as seen in a plan view around the front point $L_F$ and the rear point $L_B$, respectively.

The first electrode 11 and the second electrode 12 are placed on the workpiece w in a state where the workpiece w is slightly rotated on a horizontal plane so that the center line $L_\alpha$ connecting the middle portion $L_M$ of the left end L of the heating target region $w_1$ and the middle portion $R_M$ of the right end R thereof is substantially perpendicular to each extending direction of the first electrode 11 and the second electrode 12. In the illustrative embodiment shown in FIG. 3A and FIG. 3B, the center line $L_\alpha$ connecting a midpoint $L_C$ of the left side L and a midpoint $R_C$ of the right side R is considered and the workpiece w is placed so that the center line $L_\alpha$ is substantially perpendicular to the first electrode 11 and the second electrode 12. That is, the center line $L_\alpha$ divides the workpiece w into two with regard to the widthwise direction.

The width of the heating target region $w_1$ of the workpiece w shown in FIGS. 2 to 3B becomes narrower toward the right region $w_R$. Accordingly, as shown in FIG. 3A, by rotating the workpiece w on a horizontal plane so that the center line $L_\alpha$ is substantially perpendicular to the electrodes 11, 12 in a state where the first electrode 11 and the second electrode 12 are disposed substantially parallel to each other, the second electrode 12 is brought into contact with the left side of the heating target region $w_1$ and the first electrode 11 is placed parallel to the second electrode 12 with an interval.

Figure 1D:
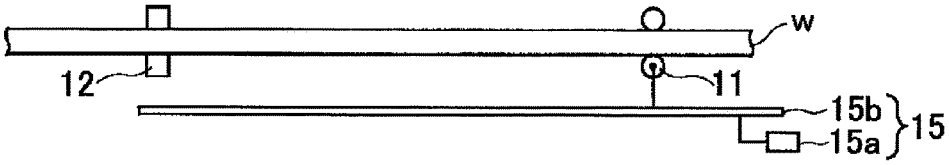

Then, the first electrode 11 is moved away from the second electrode 12 by the moving mechanism 15 while power is supplied between the first electrode 11 and the second electrode 12 from the power feeding unit 11. As shown in FIGS. 1C, 1D and 3B, the first electrode 11 is moved until it is moved completely beyond the other end R of the heating target region $w_1$ and the power supply from the power feeding unit 1 is stopped.

In the illustrative embodiment of the present invention, by rotating the workpiece w in a horizontal plane or rotating the first electrode 11 and the second electrode 12 in a horizontal plane, the electrodes 11, 12 are placed so that each of the first electrode 11 and the second electrode 12 is not parallel to the left end L and the right end R of the heating target region $w_1$, that is, the electrodes 11, 12 substantially intersect with the longitudinal direction of the workpiece w. The reason for placing the electrodes 11, 12 in this way is as follows.

When power is supplied between the first electrode 11 and the second electrode 12 from the power feeding unit 11, current flows between a portion of the workpiece w in contact with the first electrode 11 and a portion of the workpiece w in contact with the second electrode 12. The current flows through the lowest resistance portion of the workpiece w between the contact portion with the first electrode 11 and the contact portion with the second electrode 12. When, in the portion of the workpiece w between the contact portion with the first electrode 11 and the contact portion with the second electrode 12, each segment in the extending direction of the electrodes 11, 12 is homogeneous, the current flows through the shortest path. Accordingly, in the portion of the workpiece w between the first electrode 11 and the second electrode 12, the dimension along the center line $L_\alpha$ of each segment in the extending direction of the electrodes 11, 12 falls within the same range. Then, substantially equal electric current flows through the portion of the workpiece w between the first electrode 11 and the second electrode 12 and Joule heat generated by the electric current is uniform.

The temperature in the portion of the workpiece w between the first electrode 11 and the second electrode 12 is increased by the direct resistance heating. However, when the degree of the temperature rise in the portion of the workpiece w is not changed with respect to the extending direction of the electrodes 11, 12, the resistance is not changed and the current uniformly flows even when the portion of the workpiece w is virtually further segmented in the extending direction of the electrodes 11, 12. Therefore, the resistance of each segment is not greatly different from each other in the extending direction of the electrodes 11, 12 and the degree of temperature rise in unit time is approximately equal.

Next, the reason for moving the first electrode 11 by the moving mechanism 15 as shown in FIG. 1 will be described. Assumed that the thickness of the workpiece w is constant, the sectional area of the workpiece w perpendicular to the center line $L_\alpha$ is reduced along the right direction, as shown enlarged in FIG. 3. Accordingly, the first electrode 11 is moved in a direction in which the sectional area is reduced along the center line $L_\alpha$. In this way, from a state shown in FIG. 3A at which the electric current starts to be applied to a state shown in FIG. 3B at which the electric current is stopped from being applied, the total amount of heat per unit volume of the portion of the workpiece w where the electric current is applied by the first and second electrodes 11, 12 falls within a certain range, irrespective of the location on the workpiece w.

As such, by moving the first electrode 11 with respect to the region of the workpiece w where the electric current is to be applied by the first electrode 11 and the second electrode 12 from the direct resistance heating start state to the direct resistance heating end state of the pair of electrodes 13 by the power feeding unit 1, it is possible to control the amount of heat for each sub-region into which the heating target region $w_1$ is virtually divided along a moving direction of the first electrode 11 in a stripe pattern. The sub-regions are arranged along the moving direction of the first electrode 11 in a stripe pattern.

Figure 4:
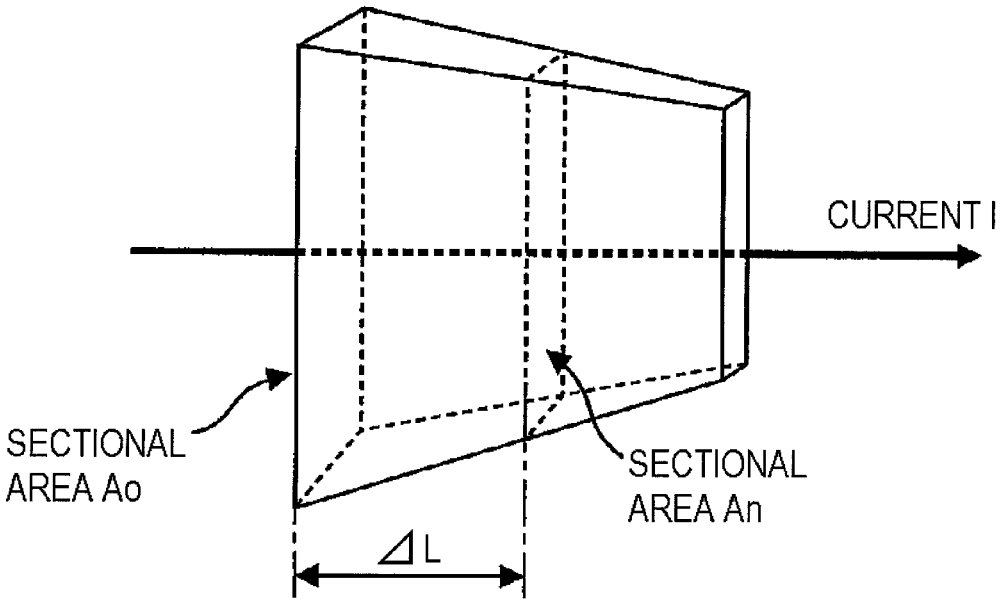
FIG. 4 is a diagram for explaining a basic relational expression regarding a direct resistance heating.

Hereinafter, the moving speed obtained by the adjustment unit 15*a* of the moving mechanism 15 will be described. As shown in FIG. 4, the temperature rise $\theta_0$ when current I is supplied to a sectional area $A_0$ of the unit length for $t_0$ seconds is obtained from the following equation:

$$\theta_0(^\circ\text{ C.})=\rho e/(\rho\cdot c)\times(I^2\times t_0)/A_0^2 \quad \text{Equation 1}$$

wherein ρe is resistivity (Ω·m), ρ is a density (kg/m$^3$), and c is specific heat (J/kg·° C.).

The temperature rise $\theta_n$ when current I is supplied to a sectional area $A_n$ of the unit length for $t_n$ seconds is obtained from the following equation:

$$\theta_n(^\circ\text{ C.})=\rho e/(\rho\cdot c)\times(I^2\times t_n)/A_n^2 \quad \text{Equation 2}$$

Here, when the current I is constant and the temperature rise $\theta_0$ is equal to the temperature rise $\theta_n$, the following relation is established.

$$t_0/A_0^2=t_n/A_n^2 \quad \text{Equation 3}$$

Accordingly, time of heating different sections to the same temperature by supplying constant current is proportional to the square of the sectional area ratio.

The speed ΔV of the moving electrode may be set as follows:

$$\Delta V=\Delta L/(t_0-t_n) \quad \text{Equation 4}$$

Here, ΔL is the length of the workpiece in the longitudinal direction.

Accordingly, the moving speed can be obtained by the adjustment unit 15*a* based on the data of the shape and dimensions of the workpiece w such as a steel material and the heating target region $w_1$, the amount of current supplied from the power feeding unit 1 and a predetermined heating temperature.

For example, assuming that the thickness of the workpiece w is constant, the region $w_2$ defined between the first electrode 11 and the second electrode 12 immediately before the end of the electric current application, that is, the region $w_2$ where the electric current is applied (hereinafter, "current applying region") has a substantially trapezoidal shape, as shown in FIG. 3B. That is, it can be approximated that the width is monotonically changed along the longitudinal direction. In order to substantially uniformly heat the current applying region $w_2$, the first electrode 11 and the second electrode 12 are spaced apart from each other and placed to extend across the current applying region $w_2$. For example, as shown in FIG. 3B, the second electrode 12 is placed at a position adjacent to one end of the current applying region $w_2$ and the first electrode 11 is placed on the right side of the second electrode 12. The first electrode 11 and the second electrode 12 have sufficient length to extend across the workpiece w. The second electrode 12 is placed on the workpiece w such that the second electrode 12 is substantially perpendicular to the center line $L_\alpha$ and brought into contact with any of the front and rear ends of the left end L of the heating target region $w_1$. Further, the first electrode 11 is placed on the workpiece w so as to be substantially parallel to the second electrode 12. At this time, the first electrode 11 is at least partially in contact with the heating target region $w_1$. Then, the first electrode 11 is moved along the center line $L_\alpha$ while power is supplied from the power feeding unit 1 to the first electrode 11 and the second electrode 12. As shown in FIG. 3B, when the first electrode 11 passes through the entire heating target region $w_1$, the electric current application is stopped. Then, even when the width of the workpiece w is changed along the moving direction of the electrode, the speed of moving the first electrode 11 can be adjusted, depending on the change in resistance per unit length. In this instance, time during which the electric current is applied to each portion of the heating target region can be adjusted in accordance with the change of the width.

In this way, with the workpiece w being virtually divided into sub-regions along the moving direction of the electrode in a widthwise stripe pattern, it is possible to ensure the applied amount of electric current appropriate for the resistance of each of the sub-regions and it is possible to heat the current applying region $w_2$ of the workpiece w to a temperature range of constant width, by adjusting the current applying time as described above.

For example, when a width of the current applying region $w_2$ is narrower to the right direction as shown in FIG. 3, the moving speed of the one electrode is adjusted on the basis of the change in the width of the first electrode 11 in contact with the current applying region $w_2$. From the equation 4, the moving speed is defined by a function which is proportional to the square of the change ratio of the sectional area.

Here, the power feeding unit 1 may be an AC power supply as well as a DC power supply. When average current of constant period is not changed even in the case of the AC power supply, the temperature rise due to the electric current can be made in the same range irrespective of the location on the heating target region of the workpiece w, by adjusting the current applying time.

Here, unlike the embodiment shown in FIG. 1 and FIG. 3, a case where the workpiece w is placed on the pair of electrodes 13 without being slightly rotated on a horizontal plane will be described as an example.

Figure 5A:
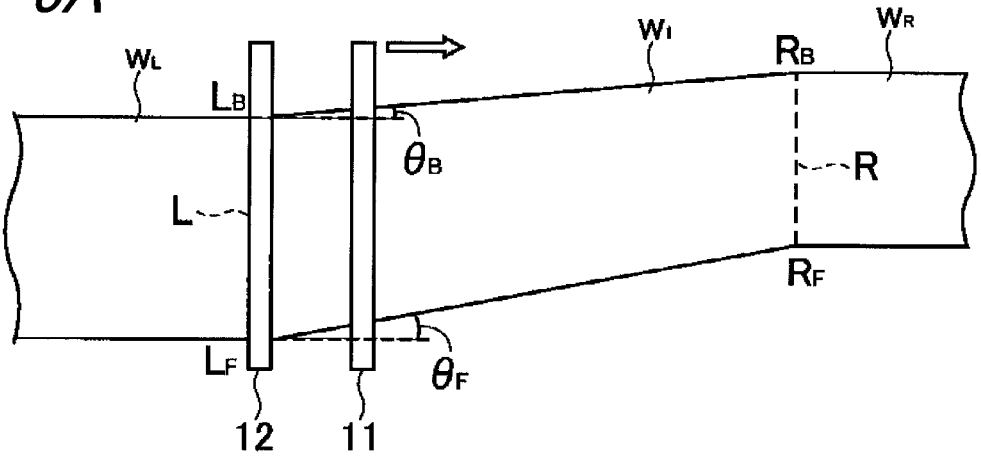

As shown in FIG. 5A, the second electrode 12 is placed to be parallel along the left end L of the heating target region $w_1$ and the first electrode 11 is placed to be parallel and slightly offset from the second electrode 12. Then, it is assumed that the first electrode 11 is moved by the moving mechanism 15.

Figure 5B:
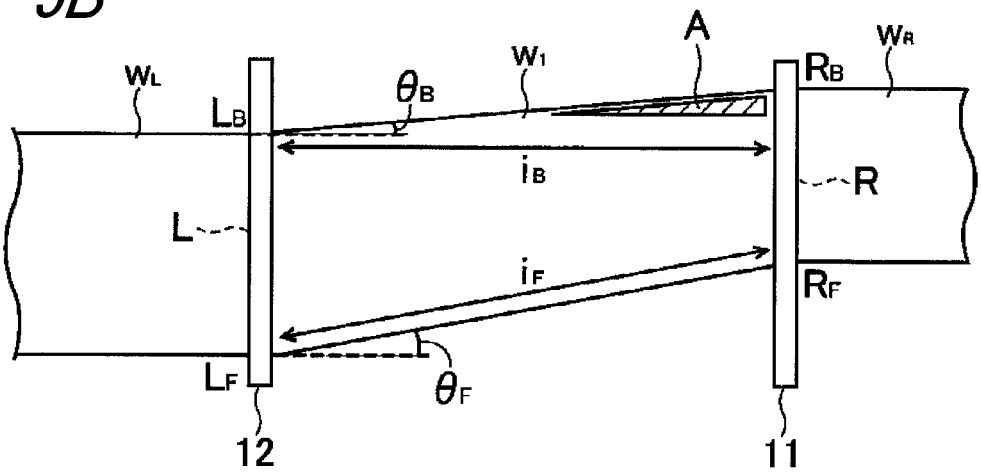

Then, in a state of immediately before the end of the electric current application as shown in FIG. 5B, current flows in a direction $i_F$ on a front side of the heating target region $w_1$ whereas current flows in a direction $i_B$ perpendicular to the left side L and the right side R of the heating target region $w_1$ on a rear side of the heating target region $w_1$. However, this makes it difficult for the current to flow in a region A shown in FIG. 5B. Accordingly, it is difficult to uniformly heat the heating target region $w_1$ of the workpiece w.

As such, in the illustrative embodiment of the present invention, the first electrode 11 and the second electrode 12 are placed on the workpiece w such that the first electrode 11 and the second electrode 12 extend across the plate-shaped workpiece w and are substantially perpendicular to the center line $L_a$ connecting the middle portion $L_M$ of the left side L and the middle portion $R_M$ of the right side R in the heating target region $w_1$ of the workpiece w. In the illustrative embodiment of the present invention, a hatched region in FIG. 3B is a region on the workpiece w defined by the first electrode 11 and the second electrode 12, that is, the current applying region $w_2$. The current applying region $w_2$ is distinguished from the heating target region $w_1$. As shown in FIG. 3B, In a state where the first electrode 11 and the second electrode 12 are most separated from each other, the current applying region $w_2$ is formed by the heating target region $w_1$, a triangular region ΔL, which is a portion of the left region $w_L$, whose one side is defined by the left side L of the heating target region $w_1$ and a triangular region ΔR, which is a portion of the right region $w_R$, whose one side is defined by the right side R of the heating target region $w_1$.

Therefore, an interval between a portion of the workpiece w in contact with the first electrode 11 and a portion of the workpiece w in contact with the second electrode 12 is likely to fall within the same range, irrespective of the location on the workpiece in a widthwise direction. That is, current supplied to a portion of the workpiece w between the first electrode 11 and the second electrode 12 can fall within the same range, irrespective of the location on the workpiece w in the widthwise direction. Accordingly, it is possible to substantially uniformly heat the plate-shaped workpiece w.

Furthermore, when the resistance per unit length of the workpiece w is increased along the center line $L_\alpha$, that is, when the resistance of each segmented region when the workpiece w is segmented in a section perpendicular to the center line $L_\alpha$ is increased along the center line $L_\alpha$, the time during which the electric current is applied can be adjusted for each portion of the heating target region $w_1$ by moving the first electrode 11 in a direction in which the resistance is increased. In this way, it is possible to substantially uniformly heat the region $w_1$ to be subjected to a heat treatment. Herein, the "unit length" is, for example, a distance of 1 cm in a direction along the center line $L_\alpha$. When a width of the heating target region $w_1$ is widest at the middle portion in the longitudinal direction of the heating target region $w_1$, and is decreased along the longitudinal direction towards respective sides, the first electrode 11 and the second electrode 12 may be placed at the middle portion so as to be substantially perpendicular to the center line $L_\alpha$, and the first electrode 11 and the second electrode 12 may be moved in opposite directions so that an interval between the electrodes is widened.

As shown in FIGS. 6 to 9, each of the electrodes 21, 22 of a direct resistance heating apparatus 20 is configured by electrode parts 21*a*, 22*a* and auxiliary electrode parts 21*b*, 22*b*, which sandwich the workpiece w from a vertical direction.

Figure 6:
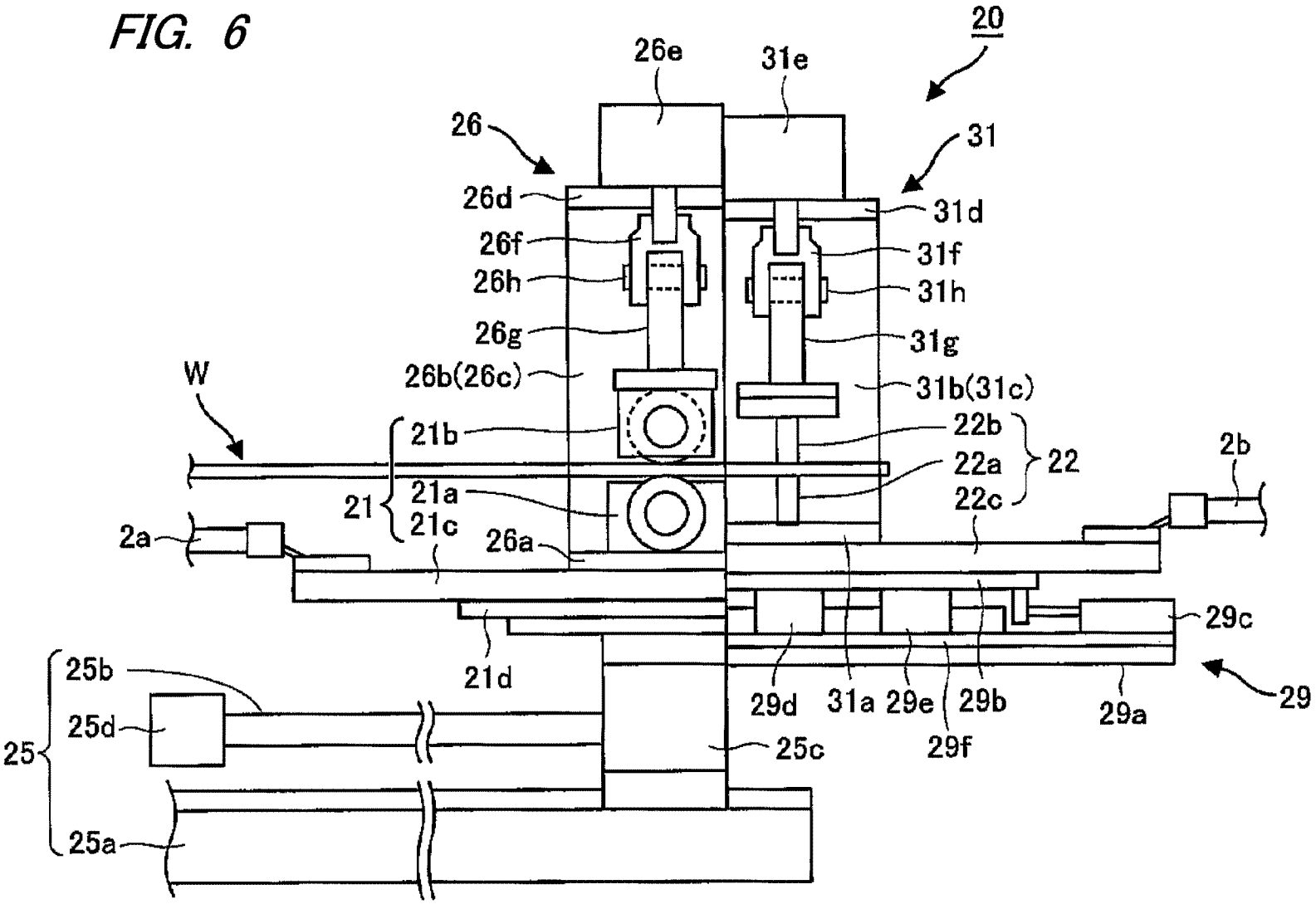
FIG. 6 is a front view of a direct resistance heating apparatus.
Figure 7:
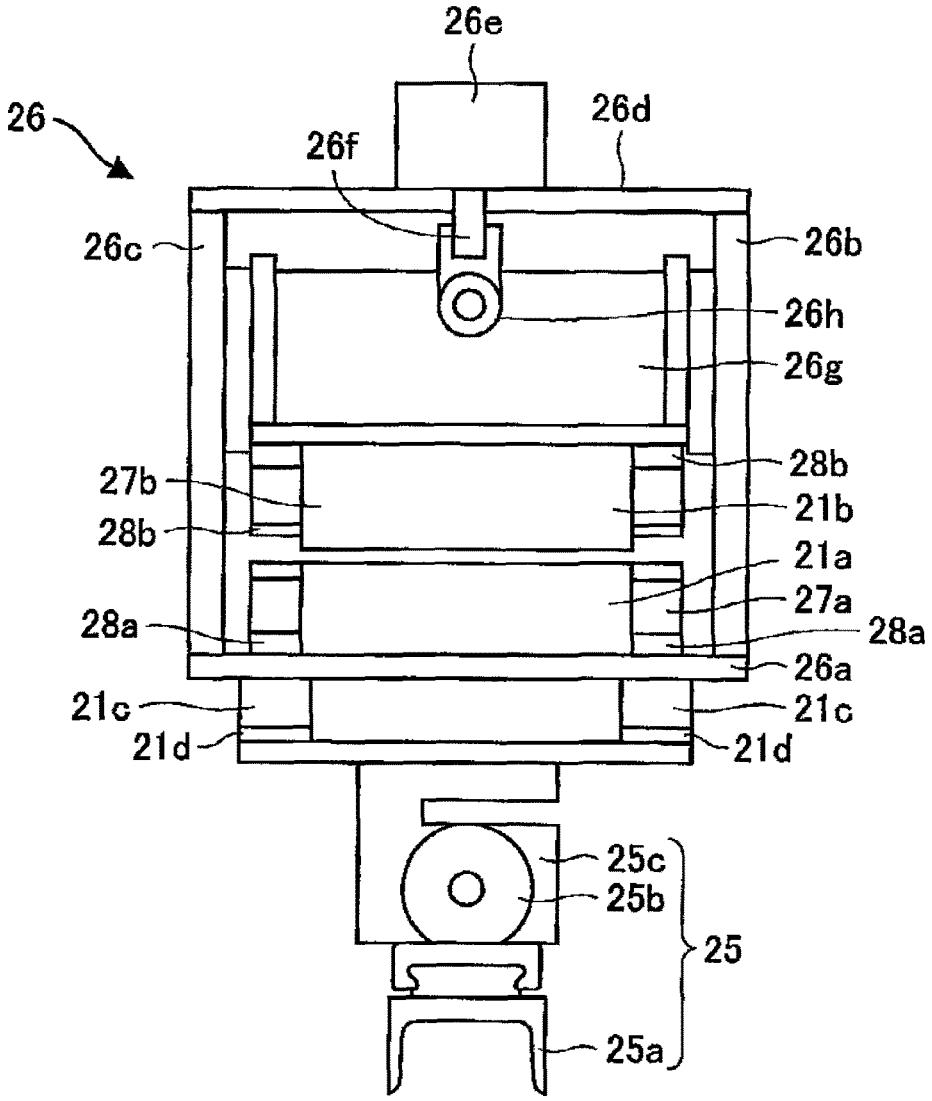
FIG. 7 is a left side view of the direct resistance heating apparatus.
Figure 8:
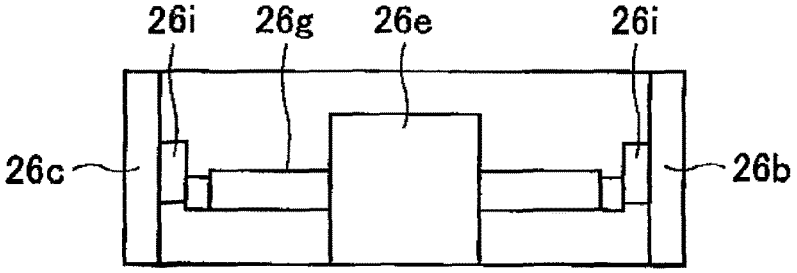
FIG. 8 is a plan view of a portion of the direct resistance heating apparatus.
Figure 9:
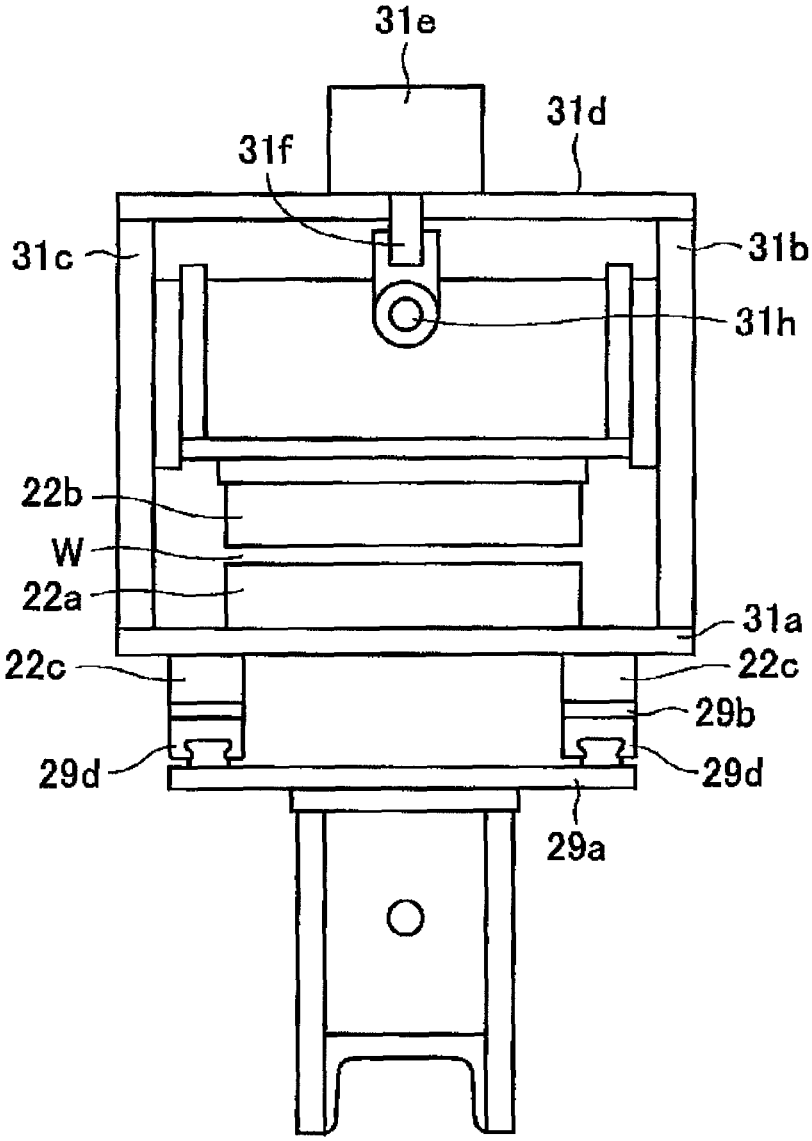
FIG. 9 is a right side view of the direct resistance heating apparatus.

In FIG. 6, a moving electrode 21 is disposed on the left side and a fixed electrode 22 is disposed on the right side, as seen from the front. The moving electrode 21 and the fixed electrode 22 respectively include paired lead parts 21*c*, 22*c*, the electrode parts 21*a*, 22*a* coming into contact with the workpiece w and the auxiliary electrode parts 21*b*, 22*b* for pressing the workpiece w toward the electrode parts 21*a*, 22*a*.

As shown in FIG. 6, a moving mechanism 25 is configured as follows. A guide rail 25*a* extends in the longitudinal direction. A movement control rod 25*b* configured by a screw shaft is disposed above the guide rail 25*a* so as to extend in the longitudinal direction. The movement control rod 25*b* is screwed to a slider 25*c* sliding on the guide rail 25*a*. The slider 25*c* is moved in the longitudinal direction by rotating the movement control rod 25*b* by a step motor 25*d* while adjusting the speed thereof.

The lead part 21*c* for the moving electrode is disposed on the slider 25*c* with an insulation plate 21*d* interposed therebetween. A wiring 2*a* is electrically connected to the power feeding unit 1 and fixed to one end of the lead part 21*c* for the moving electrode. The electrode part 21*a* is fixed to the other end of the lead part 21*c*. A hanging mechanism 26 is provided in which the auxiliary electrode part 21*b* is disposed so as to be movable in a vertical direction.

The hanging mechanism 26 is provided on a mount which is configured by a stage 26*a*, wall parts 26*b*, 26*c* and a bridge part 26*d*, etc. That is, the hanging mechanism 26 includes paired wall parts 26*b*, 26*c* which are spaced apart from each other in a widthwise direction and provided on the other end of the stage 26*a*, the bridge part 26*d* which is bridged over the upper ends of the wall parts 26*b*, 26*c*, a cylinder rod 26*e* which is mounted on an axis of the bridge part 26*d*, a clamping part 26*f* (a fixture) which is mounted to a leading end of the cylinder rod 26*e*, and a holding plate 26*g* which holds the auxiliary electrode part 21*b* in an insulating manner. The leading end of the cylinder rod 26*e* is fixed to an upper end of the clamping part 26*f* and support parts 26*i* are respectively provided on the opposing surface of the wall parts 26*b*, 26*c*, so that the holding plate 26*g* can be swingably guided by a connecting shaft 26*h*. As the cylinder rod 26*e* is moved in a vertical direction, the holding part 26*f*, the connecting shaft 26*h*, the holding plate 26*g* and the auxiliary electrode part 21*b* are moved in a vertical direction. The electrode part 21*a* and the auxiliary electrode part 21*b* extend across the heating target region of the workpiece w. Thus, an upper surface of the electrode part 21*a* and a lower surface of the auxiliary electrode part 21*b* can be entirely pressed against the workpiece w by being swung by the connecting shaft 26*h*.

In order to hold the electrode part 21*a* and the auxiliary electrode part 21*b* in contact with the plate-shaped workpiece w even when the hanging mechanism 26 and the lead part 21*c* for the moving electrode are moved in the longitudinal direction by the moving mechanism 25, rolling rollers 27*a*, 27*b* are disposed in both the electrode part 21*a* and the auxiliary electrode part 21*b* so as to extend across the workpiece w in a widthwise direction of the workpiece w. The rolling rollers 27*a*, 27*b* can be freely rolled by a pair of bearings 28*a*, 28*b*. Even when the electrode part 21*a* and the auxiliary electrode part 21*b* are moved in the longitudinal direction by the moving mechanism 25, it is possible to maintain a state where power is supplied to the workpiece w via a pair of bearings 28*a*, 28*b* and the rolling roller 27*a*.

The fixed electrode 22 is provided on the other side of the direct resistance heating apparatus 20. As shown in FIG. 6, a tension means 29 for the fixed electrode is disposed on a stage 29*a*. The lead part 22*c* for the fixed electrode is disposed on the tension means 29 for the fixed electrode with an insulation plate 29*b* interposed therebetween. The wiring 2*b* electrically connected to the power feeding unit 1 is fixed to one end of the lead part 22*c* for the fixed electrode. The electrode part 22*a* for the fixation is fixed to the other end of the lead part 22*c* for the fixed electrode. A hanging mechanism 31 in which the auxiliary electrode part 22*b* is disposed movably in a vertical direction is arranged so as to cover the electrode part 22*a* for the fixation.

The tension means 29 for the fixed electrode includes a moving means 29*c* connected to a lower surface of the insulation plate 29*b* to move the stage 29*a* in the longitudinal direction, sliders 29*d*, 29*e* for directly sliding the insulation plate 26*b* in the longitudinal direction and a guide rail 29*f* for guiding the sliders 29*d*, 29*e*. The position of the tension means 29 is adjusted by sliding the auxiliary electrode part 22*b*, the electrode part 22*a* and the lead part 22*c* for the fixed electrode in the longitudinal direction by the moving means 29*c*. By providing the tension means 29 in the direct resistance heating apparatus 20 in this manner, it is possible to flatten the workpiece w even when the workpiece w is expanded due to the direct resistance heating.

The hanging mechanism 31 includes a pair of wall parts 31*b*, 31*c* spaced apart from each other in a widthwise direction and provided upright on the other end of a stage 31*a*, a bridge part 31*d* bridging over the upper ends of the wall parts 31*b*, 31*c*, a cylinder rod 31*e* mounted on an axis of the bridge part 31*d*, a clamping part 31*f* mounted to a leading end of the cylinder rod 31*e*, and a holding plate 31*g* holding the auxiliary electrode part 22*b* in an insulating manner. The holding plate 31*g* is clamped by the clamping part 31*f* via a connecting shaft 31*h*. The leading end of the cylinder rod 31*e* is fixed to an upper end of the clamping part 31*f*. Similarly to the hanging mechanism 26, the holding plate 31*g* is swingably supported by support parts which are respectively provided on the opposing surface of the wall parts 31*b*, 31*c*. As the cylinder rod 31*e* is moved in a vertical direction, the clamping part 31*f*, the connecting shaft 31*h*, the holding plate 31*g* and the auxiliary electrode part 22*b* are moved in a vertical direction. The electrode part 22*a* and the auxiliary electrode part 22*b* extend across the heating target region of the workpiece w. Thus, an upper surface of the electrode part 22*a* and a lower surface of the auxiliary electrode part 22*b* can be entirely pressed against the workpiece w by being swung by the connecting shaft 31*h*.

Although not shown in FIGS. 6 to 9, the workpiece w is horizontally supported by a horizontal support means. The workpiece w is sandwiched and fixed by the electrode 21 and the auxiliary electrode 22. The workpiece w is sandwiched by the electrode 21 and the auxiliary electrode 22. The electrode 21 and the auxiliary electrode 22 are moved by the moving mechanism 25. The electrode 21 is moved by the moving mechanism 25 while a moving speed thereof is controlled by the speed adjustment unit 15*a*. Accordingly, by adjusting the moving speed of the electrode 21 and the auxiliary electrode 22 by the speed adjustment unit 15*a* in accordance with the shape of the workpiece w, it is possible to uniformly heat the heating target region of the workpiece w or it is possible to heat the heating target region of the workpiece w which is distributed to be smoothly changed from a high-temperature region to a low-temperature region.

In this way, in the direct resistance heating apparatus 20, the electrode part 21*a* and the auxiliary electrode part 21*b* are placed so as to sandwich the workpiece w from the upper and lower. The electrode part 21*a* has a solid structure and extends across the heating target region of the workpiece w. The electrode part 21*a* is provided so as to extend across a pair of lead parts 21*c* (bus bars) arranged along an electrode moving direction. The electrode part 21*a*, the auxiliary electrode part 21*b* and a pair of lead parts 21*c* are attached to a means which is moved along the electrode moving direction by the moving mechanism 25. At least one of the electrode part 21*a* and the auxiliary electrode part 21*b* is vertically moved by the cylinder rod 26*e* as a pressing means and therefore runs on the workpiece w while sandwiching the workpiece w by the electrode part 21*a* and the auxiliary electrode part 21*b*. In this way, the electrode part is moved while supplying power from the electrode part 21*b* to the workpiece w via the bus bar 21*c*.

In addition to the embodiment shown in FIGS. 6 to 9, the following configuration may be employed. That is, in a state where at least one of the electrode part 21*a* and the auxiliary electrode part 21*b* is vertically moved by the cylinder rod 26*e* as a pressing means and therefore the workpiece w is sandwiched by the electrode part 21*a* and the auxiliary electrode part 21*b*, the electrode part 21*a* runs on a pair of bus bars and therefore can be moved while supplying power from the electrode part 21*b* to the workpiece w via the bus bars 21*c*.

While the present invention has been described in connection with a certain embodiment thereof, various changes and modifications can be made therein, for example, in accordance with the shape and dimensions of the workpiece w. For example, when the workpiece w includes a region in which the sectional area is reduced along one direction and thus the resistance per unit length is increased, it is possible to uniformly heat the region by moving the electrode in the one direction. A longitudinal side of the outer periphery of the workpiece w connecting both ends of the outer periphery of the workpiece w is not necessarily a straight line and may be a curved line, or may be configured by connecting a plurality of straight lines and/or curved lines having different curvature.

Further, although a case of providing one heating target region on a portion of the workpiece w has been described in the foregoing embodiment, the present invention may be applied to a case where the workpiece is divided into multiple regions, each being a heating target region.

Further, the present invention may be applied to a case where the workpiece is not made of single material but configured by connecting two plate members by welding, for example. In this case, the heating target region may extend across the welding line.

One or more embodiments of the invention provide a direct resistance heating method capable of substantially uniformly heating a portion of a plate-shaped workpiece having a varying width along a longitudinal direction of the workpiece.

The invention claimed is:

1. A direct resistance heating method comprising:

placing a first electrode and a second electrode on a plate-shaped workpiece such that the first electrode and the second electrode have sufficient length to extend across the workpiece in a direction perpendicular to a center line of a heating target region of the workpiece, the center line connecting a middle portion of one side of the heating target region and a middle portion of the other side of the heating target region, and the center line being not perpendicular to both the one side and the other side of the heating target region; and moving at least one of the first electrode and the second electrode along the center line while applying electric current between the first electrode and the second electrode, wherein said placing comprises (i) placing the first electrode and the second electrode on the plate-shaped workpiece such that the first electrode and the second electrode extend in a direction parallel to both the one side and the other side of the heating target region, and (ii) rotating the workpiece with respect to each of the first electrode and the second electrode such that the first electrode and the second electrode extend in the direction perpendicular to the center line of the heating target region.

2. The direct resistance heating method according to claim 1, wherein said moving comprises moving one of the first electrode and the second electrode along the center line and in a direction in which the resistance per unit length of the workpiece increases, so as to adjust a time during which the electric current is applied for each portion of the heating target region.

3. The direct resistance heating method according to claim 1, wherein, in said moving, from a state at which the electric current starts to be applied to a state at which the electric current is stopped from being applied, a total amount of heat per unit volume of a portion of the workpiece where the electric current is applied by the first and second electrodes is uniform, irrespective of a location on the workpiece.

4. The direct resistance heating method according to claim 2, wherein said moving comprises adjusting a moving speed of the one of the first electrode and the second electrode based on a change of a width of the heating target region such that the time during which the electric current is applied for each portion of the heating target region is adjusted.

5. The direct resistance heating method according to claim 1, wherein said placing comprises rotating the workpiece or each of the first electrode and the second electrode in a horizontal plane.

6. The direct resistance heating method according to claim 1, wherein the workpiece has a symmetrically varying width along a longitudinal direction of the workpiece from the one side of the heating target region to the other side of the heating target region.

* * * * *